United States Patent [19]

Fraser

[11] 4,017,994

[45] Apr. 19, 1977

[54] SIGNATURE PROTECTION SYSTEM

[76] Inventor: Andrew S. Fraser, 120 Ashley Road, Hopkins, Minn. 55343

[22] Filed: Aug. 26, 1974

[21] Appl. No.: 500,401

[52] U.S. Cl. ..... 40/2.2; 283/9 R

[51] Int. Cl.[2] ..... G09F 3/02; B42D 15/00

[58] Field of Search ..... 283/6–9, 283/56; 40/2.2; 279/92.8, 92.1, 92.3; 206/48.6; 282/11.5

[56] References Cited

UNITED STATES PATENTS

| | | | |
|---|---|---|---|
| 1,479,534 | 1/1924 | Curtis | 283/9 R |
| 2,454,419 | 11/1948 | Abrams | 283/56 |
| 2,903,276 | 9/1959 | Bates | 283/9 R |
| 3,455,576 | 7/1969 | Hammerling | 283/7 |

FOREIGN PATENTS OR APPLICATIONS

| | | | |
|---|---|---|---|
| 602,095 | 12/1925 | France | 283/8 R |
| 721,320 | 12/1931 | France | 279/92.8 |

*Primary Examiner*—Lawrence Charles
*Attorney, Agent, or Firm*—Merchant, Gould, Smith, Edell, Welter & Schmidt

[57] ABSTRACT

An arrangement for increasing the life, readability, and security of credit cards and similar elements having a portion to receive an authorized signature. Supplied with the card or thereon is a strip of transparent material having one adhesive surface, sized to cover the signature portion of the element. When this strip is applied to the element in overlay relation to the signature, it protects the latter from smudging and rubbing off, which occasionally occurs to the point that an alarm underlay begins to appear. Any attempt to peel off the tape and alter the signature results in appearance of the alarm underlay.

2 Claims, 3 Drawing Figures

SIGNATURE PROTECTION SYSTEM

BACKGROUND OF THE INVENTION

Elements such as credit cards form an important part of life in this country. Such cards are customarily provided with a portion specially adapted to receive the authorized signature of the card holder. This is so that a cardholder can establish his identity simply by affixing his signature to a separate piece of paper: comparison of that signature with the one on the card gives reasonably secure identification.

When a credit card is stolen its only value is in the purchasing power it represents, and lawless persons can gain an advantage by removing the authorized signature and substituting their own signatures of the cardholders names. To avoid this the signature portion of such cards are provided with a warning underlay, and the signature surface is such that it tends to ablate as a result of attempted erasure, revealing the warning beneath.

Practical experience has shown that the wear and tear of ordinary use tends to blur and degrade the original signature so that it becomes smudged, dim, or otherwise nearly useless for its intended purpose. Any attempt by the cardholder to re-sign the card gives a very suspicious appearance to the card. The same wear and tear occasionally results in the at least incipient appearnace of the warning underlay, to the point where the cardholder may be embarassed by a salesperson legitimately questioning the validity of the card. For these reasons card issuing agencies now engaged in a continuous process of replacing worn or illegible cards, entirely apart from the replacement of lost or damaged ones.

One alternative, that of encapsulating the entire card in plastic, cannot be done in a mass production method by the supplier of the cards, but must be accomplished after affixing of the signature, requiring the cardholder to go to an establishment performing such surfaces, and involving an expense to him.

SUMMARY OF THE INVENTION

My invention comprises a process and means for extending the life, utility, and security of such elements as credit cards by preventing damage to authorized signatures and signature portions of the element. This I accomplish by supplying to the cardholder, with the unsigned card, a length of transparent tape having one adhesive surface. The tape is removably secured to a second portion of the element itself, if the element is made of suitable material, or to a suitably treated portion of a mailer or instruction card, from either of which it is easily removable without damage. After signing the card, the cardholder removes the strip and applies it in protective overlying relation to the signature part of the card. Abrasive contact of the users wallet or other cards for example is now prevented from reaching the signature, which remains clear and legible. Any attempt to remove the tape so as to alter the signature has a strong tendency to also remove the overlay so that the warning underlay becomes evident, and unauthorized use of the card may thus be detected.

A principal object of my invention is thus to insure the durability, utility, and security of elements such as credit cards. A more specific object is to provide such an element with an accompanying or integral length of adhesive transparent tape sized to be placed over the authorized signature by the signer to protect his signature against wear or tampering. A still more specific object is to provide a mailer which transmits to a cardholder not only his unsigned card, but the protective transparent strip just mentioned, and instructions for affixing and protecting his signature by its use.

Various other objects, advantages, and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figure 1:
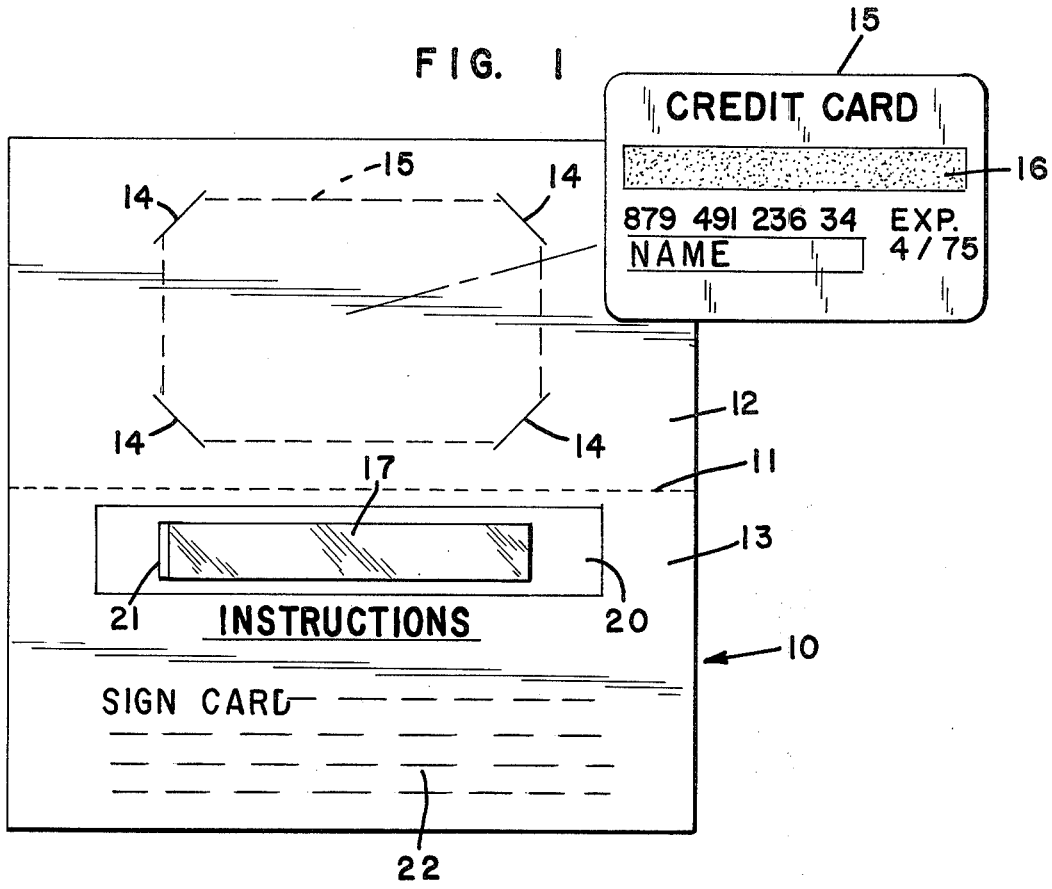
FIG. 1 is an exploded view of a first embodiment of my invention.

FIG. 1 shows a first embodiment of my invention to comprise a mailer 10 of heavy paper or cardboard intended to be folded across its center at 11 to have an upper portion 12 and a lower portion 13. Upper portion 12 has diagonal slots 14 to receive the corners of an element 15 such as a credit card. Typically such a card is of plastic, to which a signature cannot be affixed. A portion 16 of the card is therefore specially adapted by being given an overlay of material which will accept and retain a signature.

A length of transparent tape 17 having one adhesive face and sized to overlie portion 16 of card 15 in protective relation thereto is secured to lower portion 13 of the mailer: for this purpose there is applied thereto or incorporated therein at least a portion 20 to which the tape adheres removably, so that it can be lifted therefrom without being damaged. The end of the tape may be inturned on itself as at 21 to facilitate the removal of the tape if desired. For convenience, instructions for the use of the protective strip may be printed on portion 13 of the mailer as at 22.

Figure 2:
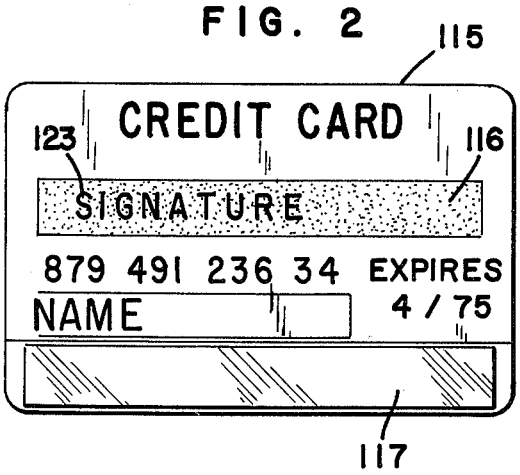
FIG. 2 shows a second embodiment of the invention.

In a second embodiment of the invention, shown in FIG. 2, the transparent tape 117 is secured initially to the card 115 itself, at a point remote from signature portion 116. In FIG. 2, the element 115 is shown with the signature 123 affixed, ready for application of the protective tape.

Figure 3:
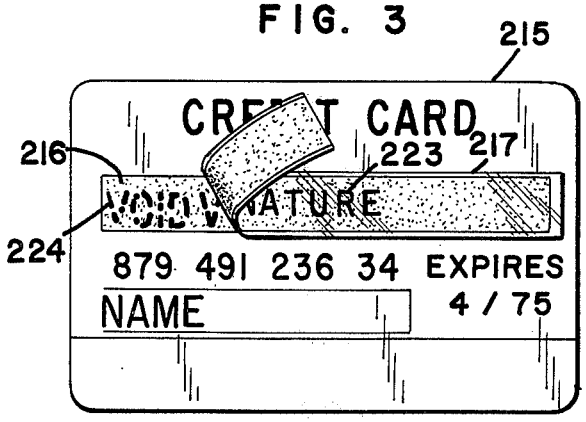
FIG. 3 shows the manner in which my invention provides security to the user.

FIG. 3 indicates how the tape 217 operates to enhance the security of the credit card 215, by peeling off at least in part the overlay on portion 216, to reveal a warning underlay 224 underneath thus giving it evidence of tampering with the card. While this effect occurs with conventional transparent adhesive tapes, I contemplate that it may be desirable to modify the adhesive, to increase its adhesion to the signature material and thus increase the effect shown in FIG. 3. I also contemplate that a special adjuvant may be added to the adhesive, coordinted with a composition of the signature material, which will further increase this effect.

While my invention has been illustrated in use with a credit card, it will be appreciated that other similar elements may advantageously be used with my invention. Moreover I do not limit my invention to the protection of signatures: numerous identification elements include affixed photographs, and my invention may readily be applied to the protection of photographs and warning that tampering with them has occurred.

Numerous objects and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim as my invention:

1. An element such as a credit card having a authorized signature which is protected against effacement, alteration or substitution, comprising, in combination:

a surface on the element, at the area intended for the signature, which is recognizable as a warning signal;

an overlay on said surface of masking material, capable of receiving and retaining a signature, which adheres to said surface with a first degree of adhesion;

and a strip of transparent, abrasion resistant material covering said overlay and said signature, and adhering to said layer with a second degree of adhesion greater than that between said overlay and said surface, so that after said strip is affixed to said overlay said signature is visible and yet protected from abrasion and alteration, and intentional removal of said strip is accompanied by removal of said overlay to display said warning signal.

2. The method of protecting an authorized signature on an element such as credit card against effacement, alteration or substitution which comprises:

a. initially producing on the element at the area intended for the signature a surface recognizable as a warning signal;

b. overlaying said surface with a layer of masking material, capable of receiving and retaining a signature, which adheres to said surface with a first degree of adhesion;

c. and providing with the element, prior to the affixation of the signature thereto a strip of transparent, abrasion resistant material sized to cover said area, and capable of adhering to said layer with a second degree of adhesion greater than that between said layer and said surface, so that when said signature is affixed to said layer and said strip is adhered thereto, the signature is visible and is protected against alteration and abrasion, while the intentional removal of said strip is accompanied by removal of said layer to expose said warning signal.

* * * * *